US005400301A

United States Patent [19]

Rackley

[11] Patent Number: 5,400,301

[45] Date of Patent: Mar. 21, 1995

[54] WRIST WATCH ALARM

[76] Inventor: Vesna K. Rackley, 1209 BlueBeard Way, Raleigh, N.C. 27604

[21] Appl. No.: 285,148

[22] Filed: Aug. 3, 1994

[51] Int. Cl.[6] ..... G04B 23/02; G04C 21/16

[52] U.S. Cl. ..... 368/72; 368/252

[58] Field of Search ..... 368/72–74, 368/75, 250, 252

[56] References Cited

U.S. PATENT DOCUMENTS

| | | | |
|---|---|---|---|
| 1,885,270 | 11/1932 | Lassiter | 368/73 |
| 4,338,681 | 7/1982 | Rapp et al. | 368/72 |
| 4,432,652 | 2/1984 | Munekata et al. | 368/69 |
| 5,089,998 | 2/1992 | Rund | 368/72 |

*Primary Examiner*—Vit W. Miska

[57] ABSTRACT

A wrist watch alarm comprising a hollow housing having a time set mark thereon; a power source disposed within the housing; timer circuitry disposed within the housing and coupled to the power source for maintaining a current time, the timer circuitry adapted to receive an alarm set signal to set an alarm time and then transmit an alarm activation signal when the current time corresponds with the alarm time; an alarm indication mechanism for providing an alarm indication upon receipt of an alarm activation signal; and a dial mechanism rotatably coupled to the housing, the dial mechanism having a plurality of alarm set indicator switches coupled to the timer circuitry, each alarm set indicator switch transmitting an alarm set signal to the timer circuitry when positioned in association with the hour set mark of the housing, each alarm set indicator switch identified with a time when an alarm activation signal is to be generated by the timer circuitry.

9 Claims, 4 Drawing Sheets

WRIST WATCH ALARM

BACKGROUND OF THE INVENTION

1. Field of the Invention

The present invention relates to a wrist watch alarm and more particularly pertains to allowing a sick or handicapped person to readily set an alarm for providing an indication that medication should be taken with a wrist watch alarm.

2. Description of the Prior Art

The use of alarm mechanisms is known in the prior art. More specifically, alarm mechanisms heretofore devised and utilized for the purpose of providing an alarm are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,875,738 to Ichikawa et al. discloses a watch with built in audio alarm device. U.S. Pat. No. 4,379,641 to Maezawa et al. discloses a multi-alarm electronic watch. U.S. Pat. No. 4,591,836 to Feignblatt, Jr. et al. discloses a battery operated panic alarm wrist watch. U.S. Pat. No. 5,050,14 to Gibbs discloses a Pill takers wrist watch with two temperature sensors. U.S. Pat. No. 5,157,640 to Backner discloses a medication alert watch and system.

While these devices fulfill their respective, particular objective and requirements, the aforementioned patents do not describe a wrist watch alarm that is specifically designed for use by sick and handicapped people for enabling them to readily set an alarm for providing an audible, visual, and vibrational indication that medication should be taken.

In this respect, the wrist watch alarm according to the present invention substantially departs from the conventional concepts and designs of the prior art, and in doing so provides an apparatus primarily developed for the purpose of allowing a sick or handicapped person to readily set an alarm for providing an indication that medication should be taken.

Therefore, it can be appreciated that there exists a continuing need for new and improved wrist watch alarm which can be used for allowing a sick or handicapped person to readily set an alarm for providing an indication that medication should be taken. In this regard, the present invention substantially fulfills this need.

SUMMARY OF THE INVENTION

In the view of the foregoing disadvantages inherent in the known types of alarm mechanisms now present in the prior art, the present invention provides an improved wrist watch alarm. As such, the general purpose of the present invention, which will be described subsequently in greater detail, is to provide a new and improved wrist watch alarm and method which has all the advantages of the prior art and none of the disadvantages.

To attain this, the present invention essentially comprises, in combination, a rigid hollow housing having a top wall, a bottom wall, and a generally tubular peripheral side wall interconnecting the top wall with the bottom wall to thereby define a hollow interior, a generally circular opening centrally disposed through the top wall, a trapezoidal projection extended from a side wall with an hour set mark inscribed thereon, and two pairs of diametrically opposed tongues extended from the side wall with each adapted to be coupled to a band for securing the housing to a user. A replaceable battery is included and disposed within the housing for providing electrical power. A translucent face plate is included and secured across the opening of the housing. Timer circuitry is included and disposed within the housing, coupled to the battery, and extended through the face plate for maintaining a current time, month, date, and day and providing a visual indication thereof. The timer circuitry is adapted to receive an alarm set signal to set an on-the-hour alarm time and then transmit an alarm activation signal when the current time corresponds with the on-the-hour alarm time. A lamp is included and disposed within the housing under the face plate and coupled to the timer circuitry for directing flashing light upwards through the face plate upon receipt of an alarm activation signal for generating a visual alarm indication. A buzzer is coupled to the timer circuitry and extended from the housing for generating an audible alarm indication upon receipt of an alarm activation signal. A vibrator button is coupled to the timer circuitry and extended through the bottom surface of the housing for generating a vibrational alarm indication upon receipt of an alarm activation signal. A transparent cover is secured to the housing over the face plate. Lastly, an annular dial is rotatably coupled to the top face of the housing about the opening thereof. The dial has eleven alarm set indicator switches radially disposed therearound at equal intervals and coupled to the timer circuitry. The alarm set indicator switches each have a single number inscribed thereon from 1 to 11 respectively and with the numbers arranged in a counter-clockwise fashion about the dial. Each alarm set indicator switch transmits an alarm set signal to the timer circuitry when aligned with the hour set mark of the housing and with the number on each alarm set indicator switch indicating a corresponding on-the-hour time that an alarm activation signal is to be generated by the timer circuitry. The dial further includes an alarm set switch having a first orientation for preventing alarm activation signals from being transmitted by the timer circuitry, thereby preventing alarm indications from being generated, and a second orientation for transmitting an alarm set signal to the timer circuitry when aligned with the hour set mark of the housing and with this alarm set signal indicating that an alarm activation signal is to be generated by the timer circuitry at an on-the-hour time of twelve o'clock. When an alarm set indicator switch is aligned with the hour set mark for setting an on-the-hour alarm time in the timer circuitry, and the current time subsequently corresponds with the on-the-hour alarm time, the face plate flashes, the buzzer sounds, and the vibrator button vibrates, thus providing an indication that medication should be taken.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wrist watch alarm which has all the advantages of the prior art alarm mechanisms and none of the disadvantages.

It is another object of the present invention to provide a new and improved wrist watch alarm which may be easily and efficiently manufactured and marketed.

It is a further object of the present invention to provide a new and improved wrist watch alarm which is of durable and reliable construction.

An even further object of the present invention is to provide a new and improved wrist watch alarm which is susceptible of a low cost of manufacture with regard to both materials and labor, and which accordingly is then susceptible of low prices of sale to the consuming public, thereby making such a wrist watch alarm economically available to the buying public.

Still yet another object of the present invention is to provide a new and improved wrist watch alarm which provides in the apparatuses and methods of the prior art some of the advantages thereof, while simultaneously overcoming some of the disadvantages normally associated therewith.

Even still another object of the present invention is to provide a new and improved wrist watch alarm for allowing a sick or handicapped person to readily set an alarm for providing an indication that medication should be taken.

Lastly, it is an object of the present invention to provide a new and improved wrist watch alarm comprising a hollow housing having a time set mark thereon; a power source disposed within the housing for providing electrical power; timer circuitry disposed within the housing and coupled to the power source for maintaining a current time, the timer circuitry adapted to receive an alarm set signal to set an alarm time and then transmit an alarm activation signal when the current time corresponds with the alarm time; alarm indication means for providing an alarm indication upon receipt of an alarm activation signal; and dial mechanism rotatably coupled to the housing, the dial mechanism having a plurality of alarm set indicator switches coupled to the timer circuitry, each alarm set indicator switch transmitting an alarm set signal to the timer circuitry when positioned in association with the hour set mark of the housing, each alarm set indicator switch identified with a time when an alarm activation signal is to be generated by the timer circuitry; whereby when an alarm set indicator switch is associated with the time set mark for setting an alarm time in the timer circuitry, and the current time subsequently corresponds with the alarm time, an alarm indication is generated, thus providing an indication that medication should be taken.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
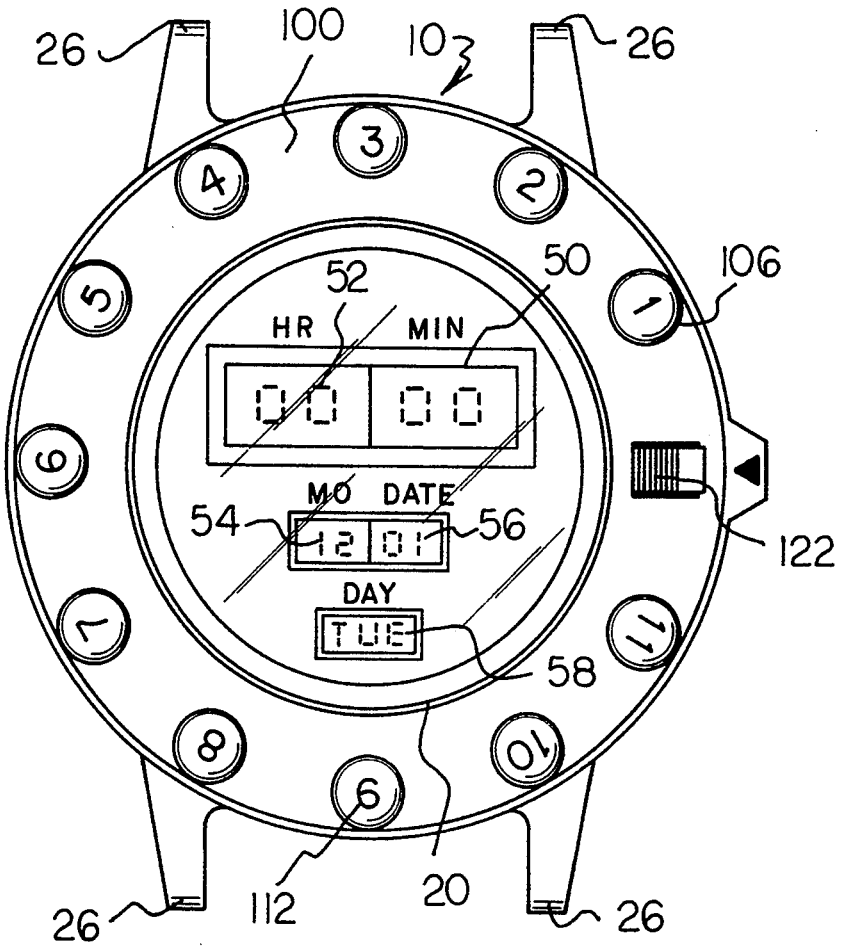
FIG. 1 is a plan view of the preferred embodiment constructed in accordance with the principles of the present invention.
Figure 2:
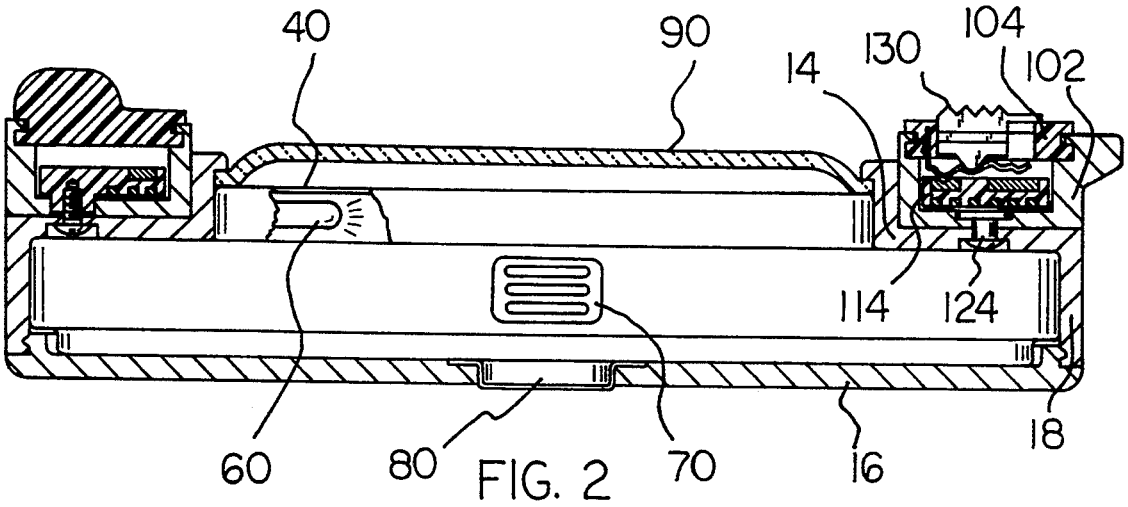
FIG. 2 is a partial cross-sectional view of the present invention depicting the coupling of the dial, buzzer, and vibrator button with the housing.
Figure 3:
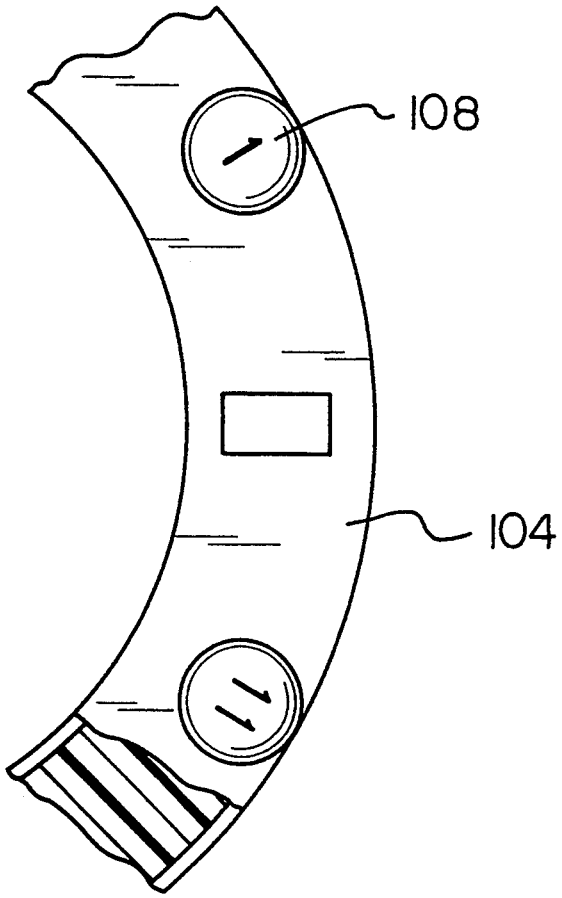
FIG. 3 is an enlarged plan view of a portion of the top face of the dial depicting several hour set indicator switches projected therefrom.
Figure 4:
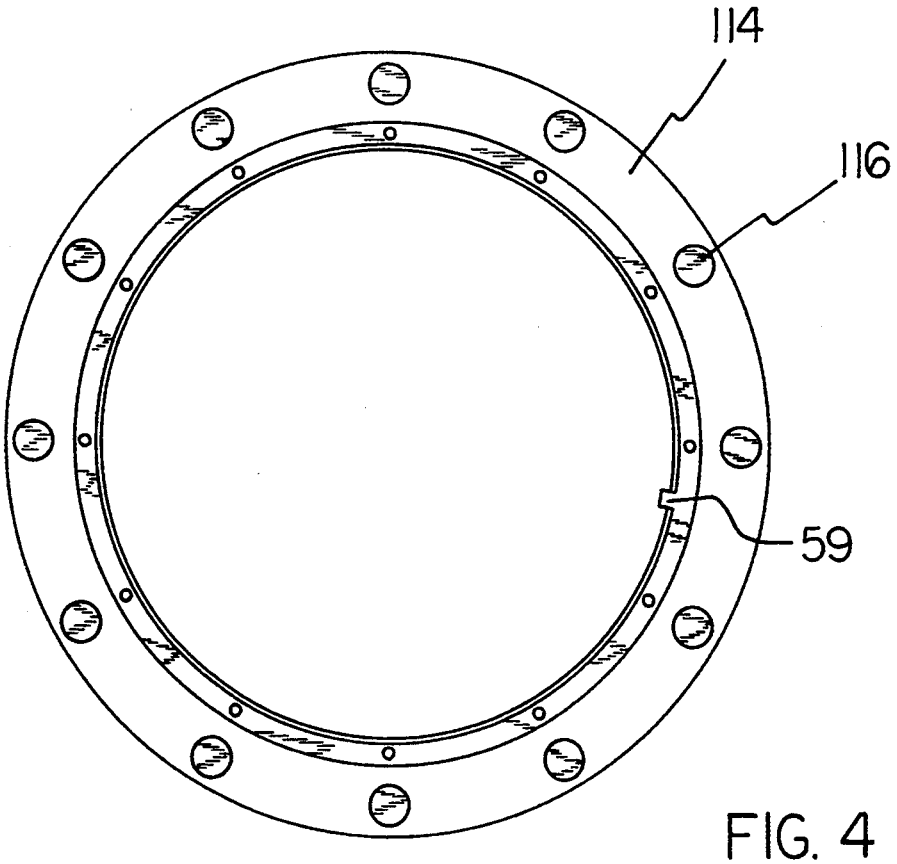
FIG. 4 is a plan view of the top face of the annular contact board and depicting the contact pads used to contact the hour set indicator switches on the dial positioned thereupon.
Figure 5:
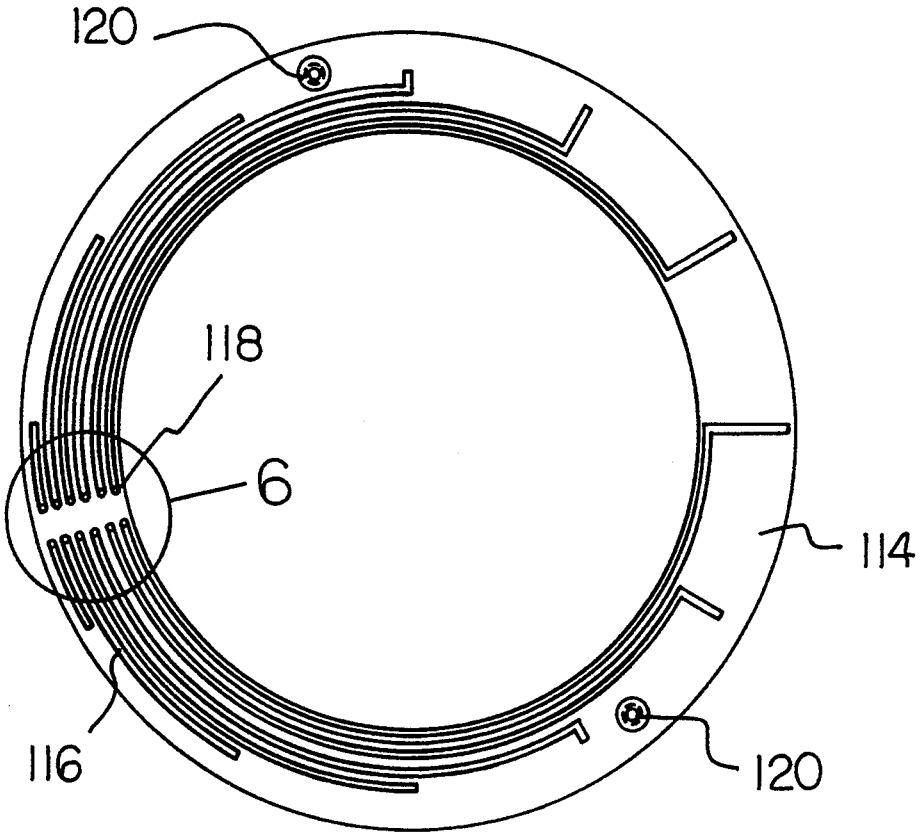
FIG. 5 is a plan view of the bottom face of the annular contact board depicting the switch matrix formed thereon extended from the contact pads on the top face to a contact plug. The contact plug is extended into the housing and coupled with the timer circuitry, thus enabling an alarm time to be set.
Figure 6:
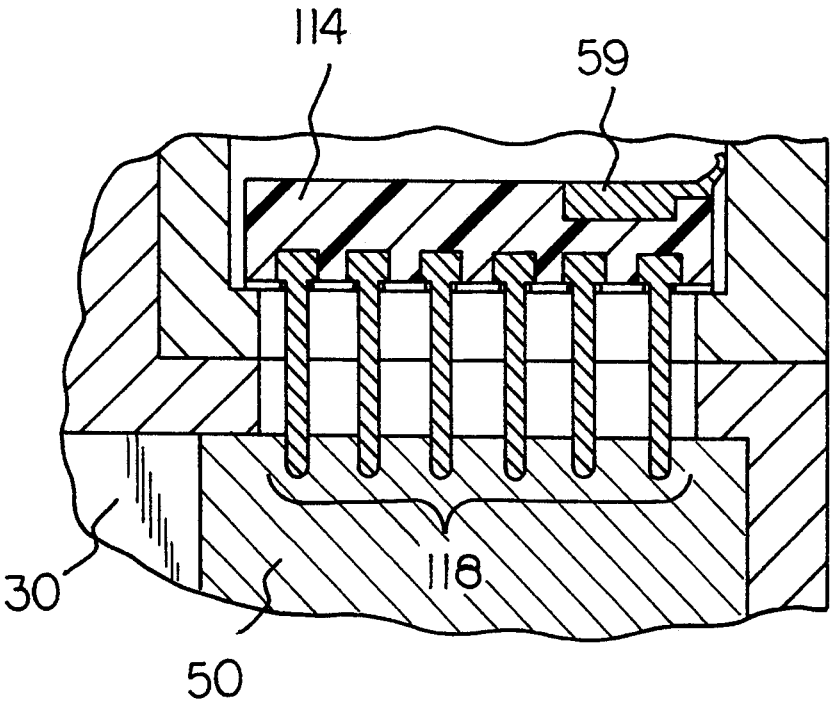
FIG. 6 is a cross-sectional view of the contact plug and its downward projection into the housing for coupling with the timer circuitry.
Figure 7:
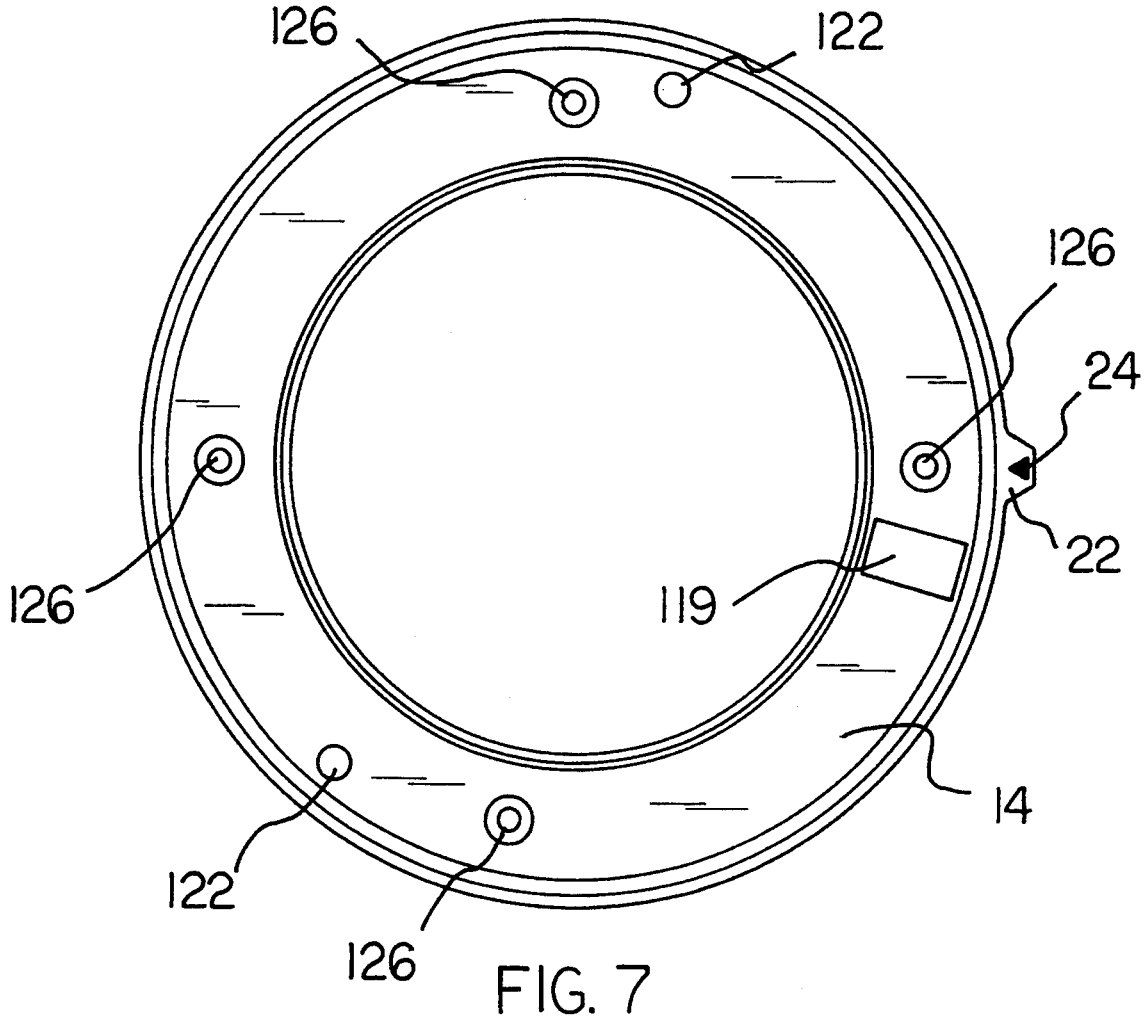
FIG. 7 is a plan view of the top surface of the housing with both the contact board and dial removed and depicting the rectangular opening through which the contact plug passes to allow alarm set indication signals to be passed to the timer circuitry.
Figure 8:
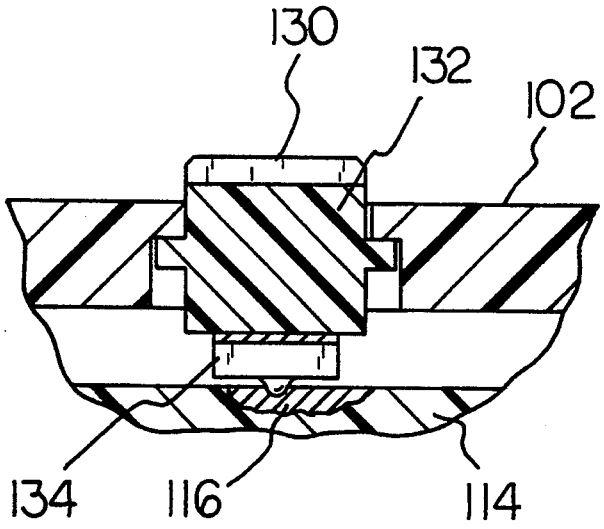
FIG. 8 is a cross-sectional view of the alarm set switch of the dial and its relation to the associated contact pad on the contact board therebelow for activating or deactivating the alarm.

With reference now to the drawings, and in particular, to FIG. 1 thereof, the preferred embodiment of the new and improved wrist watch alarm embodying the principles and concepts of the present invention and generally designated by the reference number 10 will be described.

Specifically, the present invention essentially includes nine major components. The major components are the housing, battery, face plate, timer circuitry, lamp, buzzer, vibrator button, cover, and dial. These components are interrelated to provide the intended function.

More specifically, it will be noted in the various Figures that the first major component is the housing 12. The housing is rigid and hollow in structure. It has a top wall 14, a bottom wall 16, and a generally tubular peripheral side wall 18 interconnecting the top wall with the bottom wall to thereby define a hollow interior. A generally circular opening 20 is disposed through the top wall. The housing includes a trapezoidal projection 22 extended from a side wall. This projection has an hour set mark 24 inscribed thereon in the form of an arrow. The housing also includes two pairs of diametrically opposed tongues 26. Each pair of tongues is extended from opposite sides of the side wall and adapted to be coupled to a band for securing the housing to a user.

The second major component is the battery 30. The battery is disposed within the housing 12. The battery is adapted for providing electrical power. It may be replaced when its electrical power is expended. The battery is conventional in design and commercially available.

The third major component is the face plate 40. The face plate is disc-shaped and rigid in structure. It is made with a translucent material. The face plate is secured across the opening of the housing for protecting the contents therein.

The fourth major component is the timer circuitry 50. The timer circuitry is disposed within the housing 12. The timer circuitry is operable when electrically energized. The timer circuitry is coupled to the battery 30 with a portion extended through the face plate 40 for maintaining a current time 52, month 54, date 56, and day 58 and providing a visual indication thereof through 7-segment light emitting diode display circuitry. The timer circuitry is adapted to receive and alarm set signal to set an on-the-hour alarm time. The timer circuitry is also adapted to transmit an alarm activation signal when the current time corresponds with the on-the-hour alarm time. Both the timer circuitry and battery are coupled to a ground strip 59 extended to the housing 12. The timer circuitry is conventional in design and commercially available.

The fifth major component is the lamp 60. The lamp is disposed within the housing 12 under the face plate 40 and coupled to the timer circuitry 50. The lamp includes associated circuitry for directing flashing light upwards through the face plate upon receipt of an alarm activation signal. Thus, the lamp generates a visual alarm indication. In the preferred embodiment, the lamp is a light emitting diode, but other light sources may also be used.

The sixth major component is the buzzer 70. The buzzer is coupled to the timer circuitry 50 and extended from the housing 12. The buzzer generates an audible alarm indication upon receipt of an alarm activation signal from the timer circuitry.

The seventh major component is the vibrator button 80. The vibrator button is coupled to the timer circuitry and extended through the bottom walls 16 of the housing. The vibrator button is adapted to be placed in contact with a user such as on the arm or wrist. The vibrator button generates a vibrational alarm indication upon receipt of an alarm activation signal.

The eighth major component is the cover 90. The cover is rigid and formed of a transparent material. It is secured to the housing over the face plate. The cover functions in association with the face plate to protect the timer circuitry from environmental damage due to water, dust, or the like.

The ninth major component is the dial 100. The dial is annular and rigid in structure. The dial has a cupped portion 102 with a top wall 104 secured thereover to define a channel therein. The dial has eleven alarm set indicator switches 106 radially disposed therearound at equal intervals and extended through the top wall. Each alarm set indicator switch has a knob 108 formed thereon above the top wall and an electrically conductive detent formed therebelow. The knobs of the alarm set indicator switches each have a single number 112 inscribed thereon ranging from 1 to 11, respectively. The numbers are arranged in a counter-clockwise fashion about the dial. The dial is coupled to the timer circuitry through a contact board 114 disposed within the channel between the top wall and cupped portion. The contact board has an electrically conductive switch matrix 116 formed thereon. Integral contact pads of the switch matrix are positioned below each detent of an alarm set indicator switch. The switch matrix on the contact board is extended to a contact plug 118. The contact plug is directed downwards through a plug hole 119 and coupled to the timer circuitry 50. The contact board has locator pins 120 extended downwards therefrom and positioned in the locator holes 122 of the top wall of the housing. The cupped portion of the dial is secured with bolts 124 through bolt holes 126 on the top wall of the housing. Each alarm set indicator switch transmits and alarm set signal to the timer circuitry when aligned with the hour set mark 24 of the housing. The alarm set signal is generated when a detent of an alarm set switch contacts the respective contact pad of the switch matrix on the contact board therebelow. The number on each alarm set indicator switch indicates a corresponding on-the-hour time that an alarm activation signal is to be generated by the timer circuitry.

The dial further includes an alarm set switch 128. The alarm set switch has a knurled portion 130 for allowing a user a firm grip, and intermediate portion 132 extended downwards through the top wall 102 of the dial and terminated at an electrically conductive detent 134 positionable for communication with a contact pad of the switch matrix 116 on the contact board 114. The alarm set switch has a first orientation for preventing alarm activation signals from being transmitted by the timer circuitry, thereby preventing alarm indications from being generated. Thus, once an alarm is activated, placing the alarm set switch in the first orientation disables the alarm indications. The alarm set switch also has a second orientation for transmitting an alarm set signal to the timer circuitry when the alarm set switch is aligned with the hour set mark 24 of the housing. When the alarm set signal is placed in the second orientation, it indicates that an alarm indication signal is to be generated by the timer circuitry at an on-the-hour time of twelve o'clock. When an alarm set indicator switch is aligned with the hour set mark for setting an on-the-hour alarm time in the timer circuitry, and the current time subsequently corresponds with the on-the-hour alarm time, the face plate flashes, the buzzer sounds, and the vibrator button vibrates, thus providing an indication that medication should be taken by a user. The alarm indications can then be deactivated by placing the alarm set switch in the first orientation or aligning the hour set mark with another alarm set indicator switch.

Many people, especially the elderly, must take medication every day in order to stay healthy. It is extremely important that they take this medication regularly as prescribed by the doctor. Yet it is difficult for old people (or anyone who must take medication regularly) to remember when to take each pill. This situation is further complicated because the medicines they must take may vary for each day. The present invention provides a watch with a timer designed specifically to remind people when to take their medication.

The present invention resembles a common wristwatch with 11 round alarm set indicator switches around the outside. The alarm set indicator switches are associated with an alarm set switch used to stop the alarms. The present invention has an alarm, a lamp formed of a yellow light emitting diode associated with the face that is capable of flashing, and a vibrating device in the bottom.

The person rotates the dial and locks in the appropriate alarm set indicator switch next to the hour set mark for indicating he must take medication. For example, if a person is required to take a pill at 3:00, they lock in the hour set indicator switch next to the 3. Locking the hour set indicator switch sets the alarm. When the time is 3:00, the yellow light emitting diode flashes, the audible alarm sounds, and the vibrator pulses against the wrist for providing a three-way reminder. This three-way alarm system enables people with hearing and vision impairments to also use the device. A person can then push in the alarm set switch to stop the alarms and take the pill. If a person must take another pill at 5:00, he can rotate the dial of the present invention ahead two notches. The alarm will then be activated in another two hours.

The present invention is battery operated and could be provided with a box to store a week's supply of medication. It could be worn on the wrist, around the neck, or around the ankle, and should appeal to anyone who has forgotten to take their medicine on time.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A wrist watch alarm for allowing a sick or handicapped person to readily set an alarm for providing an indication that medication should be taken comprising, in combination:

a rigid hollow housing having a top wall, a bottom wall, and a generally tubular peripheral side wall interconnecting the top wall with the bottom wall to thereby define a hollow interior, a generally circular opening centrally disposed through the top wall, a trapezoidal projection extended from a side wall with an hour set mark inscribed thereon, and two pairs of diametrically opposed tongues extended from the side wall with each adapted to be coupled to a band for securing the housing to a user;

a replaceable battery disposed within the housing for providing electrical power;

a translucent face plate secured across the opening of the housing;

timer circuitry disposed within the housing, coupled to the battery, and extended through the face plate for maintaining a current time, month, date, and day and providing a visual indication thereof, the timer circuitry adapted to receive an alarm set signal to set an on-the-hour alarm time and then transmit an alarm activation signal when the current time corresponds with the on-the-hour alarm time;

a light emitting diode disposed within the housing under the face plate and coupled to the timer circuitry for directing flashing light upwards through the face plate upon receipt of an alarm activation signal for generating a visual alarm indication;

a buzzer coupled to the timer circuitry and extended from the housing for generating an audible alarm indication upon receipt of an alarm activation signal;

a vibrator button coupled to the timer circuitry and extended through the bottom surface of the housing for generating a vibrational alarm indication upon receipt of an alarm activation signal;

a transparent cover secured to the housing over the face plate; and an annular dial rotatably coupled to the top face of the housing about the opening thereof, the dial having eleven alarm set indicator switches radially disposed therearound at equal intervals and coupled to the timer circuitry, the alarm set indicator switches each having a single number inscribed thereon from 1 to 11 respectively and with the numbers arranged in a counter-clockwise fashion about the dial, each alarm set indicator switch transmitting an alarm set signal to the timer circuitry when aligned with the hour set mark of the housing and with the number on each alarm set indicator switch indicating a corresponding on-the-hour time that an alarm activation signal is to be generated by the timer circuitry, the dial further including an alarm set switch having a first orientation for preventing alarm activation signals from being transmitted by the timer circuitry, thereby preventing alarm indications from being generated, and a second orientation for transmitting an alarm set signal to the timer circuitry when aligned with the hour set mark of the housing with this alarm set signal indicating that an alarm activation signal is to be generated by the timer circuitry at an on-the-hour time of twelve o'clock;

whereby when an alarm set indicator switch is aligned with the hour set mark for setting an on-the-hour alarm time in the timer circuitry, and the current time subsequently corresponds with the on-the-hour alarm time, the face plate flashes, the buzzer sounds, and the vibrator button vibrates, thus providing an indication that medication should be taken.

2. A wrist watch alarm comprising:

a hollow housing having a time set mark thereon;

a power source disposed within the housing for providing electrical power;

timer circuitry disposed within the housing and coupled to the power source for maintaining a current time, the timer circuitry adapted to receive an alarm set signal to set an alarm time and then transmit an alarm activation signal when the current time corresponds with the alarm time;

alarm indication means for providing an alarm indication upon receipt of an alarm activation signal; and a dial mechanism rotatably coupled to the housing, the dial mechanism having a plurality of alarm set indicator switches coupled to the timer circuitry, each alarm set indicator switch transmitting an alarm set signal to the timer circuitry when positioned in association with the hour set mark of the housing, each alarm set indicator switch identified with a time when an alarm activation signal is to be generated by the timer circuitry;

whereby when an alarm set indicator switch is associated with the time set mark for setting an alarm time in the timer circuitry, and the current time subsequently corresponds with the alarm time, an alarm indication is generated, thus providing an indication that medication should be taken.

3. The wrist watch alarm as set forth in claim 2 further including securement means extended from the housing and adapted for securing the housing to a user.

4. The wrist watch alarm as set forth in claim 2 further including a translucent face plate secured across the opening of the housing with the timer circuitry extended therethrough for viewing.

5. The wrist watch alarm as set forth in claim 2 further wherein the timer circuitry further maintains a current date of the year.

6. The wrist watch alarm as set forth in claim 2 wherein the alarm indication means comprises a lamp disposed within the housing and coupled to the timer circuitry for directing flashing light upwards through the opening of the housing upon receipt of an alarm activation signal for generating a visual alarm indication.

7. The wrist watch alarm as set forth in claim 2 wherein the alarm indication means comprises a buzzer coupled to the timer circuitry for generating an audible alarm indication upon receipt of an alarm activation signal.

8. The wrist watch alarm as set forth in claim 2 wherein the alarm indication means comprises a vibrator mechanism coupled to the timer circuitry for generating a vibrational alarm indication upon receipt of an alarm activation signal.

9. The wrist watch alarm as set forth in claim 2 further including an alarm set switch having an orientation for preventing alarm activation signals from being transmitted by the timer circuitry, thereby preventing alarm indications from being generated.

* * * * *